United States Patent [19]

Fear

[11] Patent Number: 4,805,775

[45] **Date of Patent: * Feb. 21, 1989**

[54] CARTON WITH PRODUCT INDICATING TAB

[75] Inventor: Robert E. Fear, Wheaton, Ill.

[73] Assignee: Continental Bondware, Inc., Rolling Meadows, Ill.

[ * ] Notice: The portion of the term of this patent subsequent to Dec. 23, 2003 has been disclaimed.

[21] Appl. No.: 933,115

[22] Filed: Nov. 21, 1986

Related U.S. Application Data

[63] Continuation of Ser. No. 811,366, Dec. 20, 1985, Pat. No. 4,630,733.

[51] Int. Cl.[4] ..... B65D 73/00

[52] U.S. Cl. ..... 206/459; 229/16 D

[58] Field of Search ..... 206/459, 601, 605, 612; 229/16 R, 17 R, 17 G, 16 D; 116/200, 335

[56] References Cited

U.S. PATENT DOCUMENTS

| | | | |
|---|---|---|---|
| 3,127,082 | 3/1964 | Meyer-Jagenberg | 229/17 G |
| 3,498,815 | 3/1970 | Bichaylo et al. | 206/459 |
| 3,770,185 | 11/1973 | Reeves | 229/17 G |
| 3,912,081 | 10/1975 | Haines et al. | 206/459 |
| 3,958,744 | 5/1976 | Herglotz | 229/16 R |
| 4,244,474 | 1/1981 | Wise | 229/17 G |
| 4,630,733 | 12/1986 | Fear | 206/429 |

*Primary Examiner*—David T. Fidei

*Attorney, Agent, or Firm*—Charles E. Brown; Paul Shapiro; Charles A. Brown

[57] ABSTRACT

This relates to a device for identifying a product which may be placed within a carton. Most particularly, it relates to cartons for drinks served at a fast food establishment. The carton is formed of a paperboard having a plastic facing both interiorly and exteriorly. Identifying indicia is printed on the carton adjacent a corner of the carton and tabs are defined by cut lines which extend through the outer plastic layer and terminate within the paperboard core with the paperboard being radially delaminatable. Free ends of the cut lines remote from the corner are joined by a fold line. When the carton is folded to define corners, the tabs, which extend across the corners, automatically have their starting ends displaced from the plane of the paperboard so as to be radially grippable and displaceable. The projecting tabs also function as anti-stacking devices in that they project from the corners and prevent telescoped open cartons from wedging one within the other when they are stacked for ease of handling and shipment.

11 Claims, 1 Drawing Sheet

CARTON WITH PRODUCT INDICATING TAB

This application is a continuation in part of my copending application Ser. No. 811,366 filed Dec. 20, 1985, now U.S. Pat. No. 4,630,733.

This invention relates in general to new and useful improvements in cartons intended to have received therein various products, most particularly cartons for receiving different drinks in a fast food store, and most particularly to the formation of a tab or tabs for identifying the product.

Most particularly, the invention relates to a container or a carton formed of a paperboard laminate generally known as polyboard. The laminate includes a paperboard core which is readily delaminatable and plastic surface layers or coatings.

In accordance with this invention, each tab is formed by a cut which extends through the plastic outer surface layer and terminates within the paperboard core. Most particularly, each tab has a rounded starting end which extends across a fold line in a blank from which the carton is formed so that when the carton is folded during the erection of the carton, the starting end of the tab will automatically separate from the laminate and project from the corresponding corner of the carton. The rounded projecting tab starting end portion may then be readily grasped for displacement.

In accordance with my prior above-identified application, the tab is defined by a continuous cut line so as to have a tail end. Thus when the tab is torn relative to the carton, it will be completely separated from the carton leaving an exposed portion of the core to identify the product. In practice, my prior tab arrangement has proven to have one deficiency. The tabs are to be completely removed from the carton. As a result, either the placing of each tab in a waste paper basket will be time consuming or the removed tab is merely discarded cluttering the floor.

In accordance with this invention, the configuration of the tab is modified so in lieu of having a pointed tail, the tab has a square end which is defined by a fold line impressed in the outer surface layer with the fold line defining a hinge about which the tab hinges as opposed to being completely removed from the carton. The retained tab serves its intended product identifying function while not being removed to result in a clutter.

The projecting rounded starting end of the tab also serves a further function. Cartons of the type to which the invention is directed are generally stacked in their open state and have a tendency to wedge, one within the other. The projecting starting end of the tabs serve to prevent such wedging.

With the above and other objects in view that will hereinafter appear, the nature of the invention will be more clearly understood by reference to the following detailed description, the appended claims, and the several views illustrated in the accompanying drawing.

Figure 1:
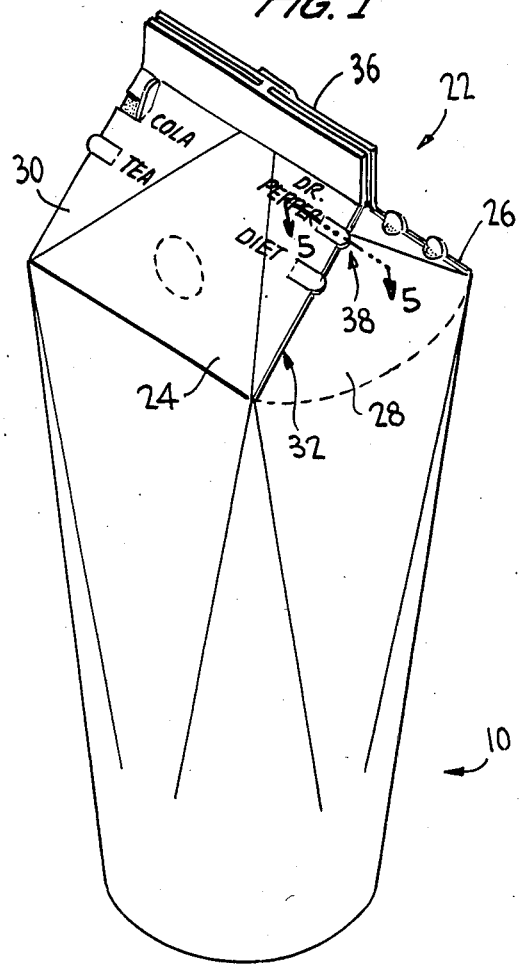
FIG. 1 is a top perspective view of a closed carton formed in accordance with this invention.

Referring now to the drawings in detail, it will be seen that there is illustrated in FIG. 1 a conventional carton generally identified by the numeral 10. The carton 10 is formed of a laminate best shown in FIG. 4. The laminate includes a readily delaminatable paperboard core 14 with the opposite faces of the laminate 12 being formed by a plastic material. The laminate 12 may be considered to have an outer surface layer or coating 16 and an inner surface layer or coating 18.

Normally the core 14 will be of a grayish-white color as is common with paperboard while the outer surface layer 16 will preferably be colored in accordance with the color theme of the packager. Thus, as will be readily apparent hereinafter, when an associated tab is displaced, there will be a color contrast to readily indicate the displacement of such tab.

Figure 2:
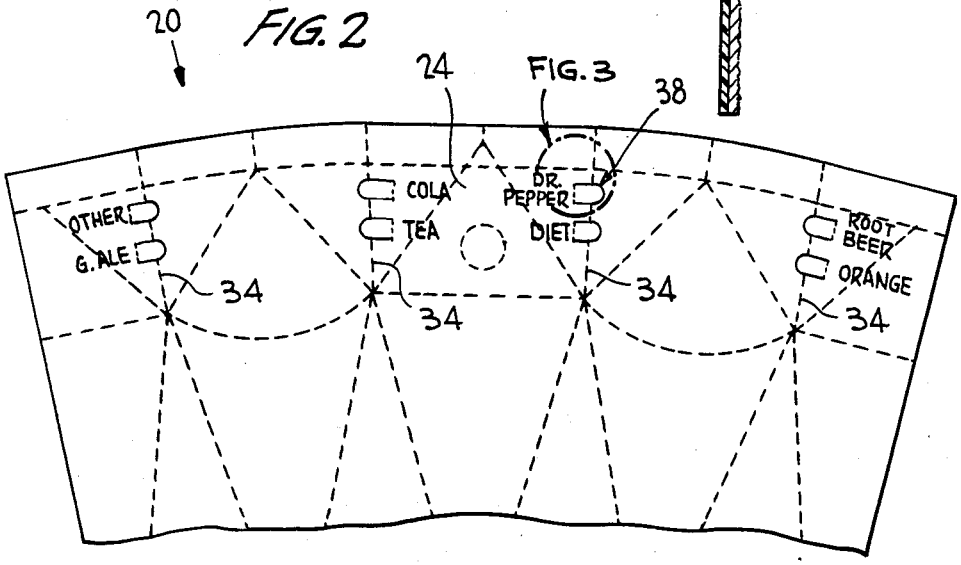
FIG. 2 is a fragmentary plan view of a blank from which the carton of FIG. 1 is folded.

The carton 10 is formed from a blank, generally identified by the numeral 20, which is formed from the laminate 12, the blank 20 being shown in FIG. 2.

The carton 10 may be provided with a closed top, generally identified by the numeral 22. The closed top 22 basically includes opposite top panels 24, 26 and folded top end panel arrangements 28, 30 so as to define at each end of each of the panels 24, 26 a corner 32. The corner 32 is defined in the blank by a fold line 34. It will be understood that there will be four such corners 32 defined by four fold lines 34.

The carton 10 is closed by bonding together the opposed facing layers of a plurality of terminal flaps 36, as is best shown at the top of FIG. 1.

It is to be understood that the carton 10 is primarily intended to be utilized in the packaging of drinks and that the same carton 10 may be utilized in the packaging of numerous drinks. In the illustrated embodiment of the blank 20, eight such drinks are identified. A removed tab will identify the drink which has been packaged in the carton 10.

Figure 3:
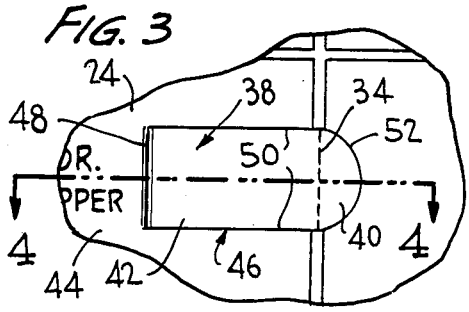
FIG. 3 is an enlarged plan view of a portion of the blank of FIG. 2 showing the specific details of one tab and its relationship to a corner forming fold line.

Referring now to FIG. 3, it will be seen that there is illustrated the construction of a typical tab, the tab being identified by the numeral 38. The tab 38 extends across the fold line 34 and has a rounded starting end 40 and is of a generally uniform length to a trailing end 42. The associated panel, for example the panel 24, has printed thereon indicia 44 disposed immediately adjacent the trailing end 42 of the tab 38. Each tab is defined by a generally U-shaped cut line 46 and a hinge defining fold line 48. As is best shown in FIG. 3, the cut line 46, which is U-shaped in outline, includes a pair of generally parallel legs 50 which are joined together by a bight portion 52 disposed remote from the hinge defining fold line 48. The hinge defining fold line 48 extends between the legs 50 at the free ends thereof.

Figure 4:
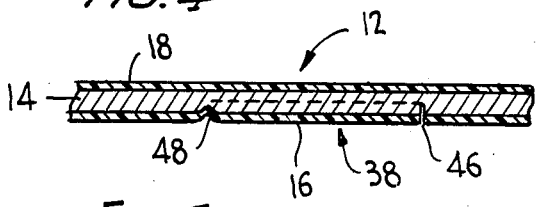
FIG. 4 is a fragmentary sectional view taken generally along the line 4—4 of FIG. 3 and shows the cut line and the tab remaining hinge defining a fold line formed in the laminate from which the blank is formed so as to define the tab.

As is best shown in FIG. 4, the cut line 46 extends through the outer surface layer 16 and terminates within the core 14. On the other hand, it will be seen that the fold line 48 is formed by crush scoring the core 14. Since the core 14 is formed of readily delaminatable paperboard, it will be seen that it is possible to tear the tab 38 out of the laminate 12.

Figure 5:
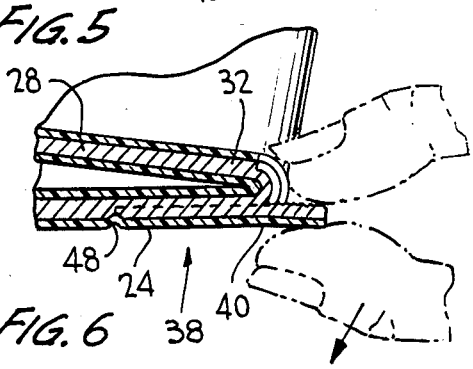
FIG. 5 is a sectional view taken generally along the line 5—5 of FIG. 1 and shows the manner in which the rounded starting end of the tab is automatically separated from the laminate from which the carton is formed so that the rounded end of the tab will project beyond the carton corner.

In the folding of the blank 20 to form the carton 10, with the top of the carton open, there are formed the corners 32. In the forming of the corners 32, the starting end 40 of each tab 38 remains within the plane of the panel in which the tab 38 is primarily formed, as is best shown in FIG. 5, with the result that the tab starting end 40 projects from the corner. This projecting of the starting end has a two-fold advantage. First of all, the open cartons 10 are stacked for shipment and handling. The open cartons have a tendency to wedge together. However, the rounded starting portions 40 of the tab project from their respective corners sufficiently to prevent such wedging between the stacked cartons. While this has not been specifically illustrated, it should be obvious to one skilled in the art how the tabs will function to maintain a spacing between telescoped cartons.

Figure 6:
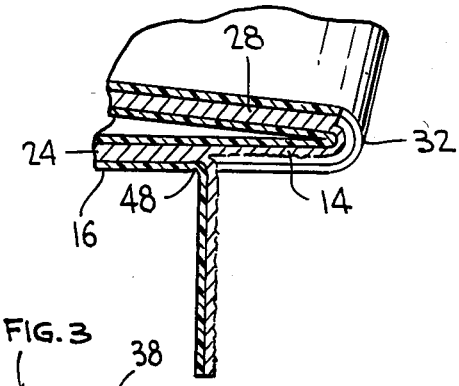
FIG. 6 is an enlarged fragmentary sectional view similar to FIG. 5 with the tab being displaced relative to the carton to identify the product packed within the carton.

Next, and most particularly, because the rounded starting end 40 of the tab 38 automatically delaminates from the remainder of the carton at the respective corner 32, the projecting starting end 40 may be readily grasped between one's thumb and forefinger, as shown in FIG. 5, for the removal of the tab 38. Thus after a particular drink has been packaged within the carton 10, the person filling the carton 10 may identify the product packaged therein by displacing the proper tab 38 and folding the same back along the hinge defining fold line 48. The carton with the tab displaced is best shown in FIG. 6 wherein it will be seen that the core 14 will be readily observable since the core 14 is of a different color from the outer surface layer 16. The displacement of the tab 38 results in identifying indicia associated with the printed indicia so as to identify the packaged product.

It will be readily apparent that the identifying tabs 38 as well as the identifying indicia 44 associated therewith may be formed at practically no extra cost in that the indicia may be part of the overall printing of the blank and the cut lines 46 and the fold line 48 may be formed by the blank forming equipment. Therefore, except for the original setup costs, the tabs 38 may be formed at no extra cost.

It is again particularly pointed out that the carton 10 has plural corners 32 and that each corner 32 may have formed there across a plurality of the tabs 38. While the number of tabs 38 illustrated in FIG. 2 is eight, there may be even more tabs along the various corners or there may be less.

Although only a preferred embodiment of the construction and configuration of the identification tab has been specifically illustrated and described herein, it is to be understood that minor variations may be made in the identification tab without departing from the spirit and scope of the invention as defined by the appended claims.

I claim:

1. A carton formed of a laminate including a core formed of a readily delaminatable material and separate inner and outer surface layers, said carton having at least one corner whereat said laminate is generally reversely folded, at least one product indentifying tab formed at said corner by a cut line through said outer surface and terminating in said core, said tab terminating at and being permanently connected to said carton along a fold line, said product identifying tab having a starting end extending partially around said corner and said fold line being remote from said starting end, and product identifying indicia on said carton generally aligned with said tab and positioned adjacent said fold line, said starting end being rounded to effect automatic separation of said tab starting end from said laminate when said laminate is folded to form said corner.

2. A carton according to claim 1 wherein said tab starting end is free of said laminate and projects beyond said carton at said corner for ease of grasping.

3. A carton according to claim 1 wherein said core and said outer surface layer are differently colored to enhance the observation of a removed tab.

4. A carton according to claim 1 wherein said carton has a folded top portion, and said corner is part of said top portion.

5. A carton according to claim 4 wherein there are a plurality of said corners and there are said tabs on more than one of said corners.

6. A carton according to claim 4 wherein said folded top portion includes a top panel, said tab is primarily formed in said top panel, and said indicia is on said top panel.

7. A carton according to claim 1 wherein there are a plurality of tabs on said corner.

8. A carton according to claim 1 wherein said cut line is U-shaped and includes a pair of spaced generally parallel legs connected at free ends by said fold line.

9. A carton according to claim 1 wherein said fold line is in the form of a crush scoring of said laminate.

10. A blank for a carton, said blank being formed of a laminate including a core formed of readily delaminatable material and separate inner and outer surface layers, said blank having at least one carton panel defining fold line for defining a reversely folded carton corner between two carton panels separated by said fold line, a cut line through said outer surface layer and terminating in said core, said cut line being generally U-shaped and defining a product identifying tab, said cut line having two generally parallel legs and a bight portion, free ends of said legs being joined by a hinge forming fold line in said outer surface layer for retaining a connection between a displaced tab and an associated carton panel, said cut line extending across said carton panel defining fold line to have a starting portion in one of said panels and a hinged end in the other of said panels, and product identifying indicia on said other panel adjacent said hinge forming fold line, said tab starting end being rounded in accordance with said cut line bight portion to effect automatic separation of said tab starting end from said laminate when said laminate is folded to form said corner.

11. A blank according to claim 10 wherein said core and said outer surface layer are differently colored to enhance the observation of a removed tab.

* * * * *